US010436489B2

(12) United States Patent
Ma et al.

(10) Patent No.: US 10,436,489 B2
(45) Date of Patent: Oct. 8, 2019

(54) METHOD AND DEVICE FOR CONTROLLING REFRIGERATOR IN AIR CONDITIONING SYSTEM AND AIR CONDITIONING SYSTEM

(71) Applicants: GD MIDEA HEATING & VENTILATING EQUIPMENT CO., LTD., Foshan (CN); MIDEA GROUP CO., LTD., Foshan (CN)

(72) Inventors: Xihua Ma, Foshan (CN); Yongfeng Xu, Foshan (CN); Meibing Xiong, Foshan (CN); Weilong Hu, Foshan (CN)

( * ) Notice: Subject to any disclaimer, the term of this patent is extended or adjusted under 35 U.S.C. 154(b) by 134 days.

(21) Appl. No.: 15/329,452

(22) PCT Filed: Aug. 28, 2015

(86) PCT No.: PCT/CN2015/088396
§ 371 (c)(1),
(2) Date: Jan. 26, 2017

(87) PCT Pub. No.: WO2016/107202
PCT Pub. Date: Jul. 7, 2016

(65) Prior Publication Data

US 2017/0219266 A1 Aug. 3, 2017

(30) Foreign Application Priority Data

Dec. 29, 2014 (CN) ..... 2014 1 0849263

(51) Int. Cl.
*F25B 49/02* (2006.01)
*F24F 11/30* (2018.01)
(Continued)

(52) U.S. Cl.
CPC ..... *F25B 49/02* (2013.01); *F24F 11/00* (2013.01); *F24F 11/30* (2018.01); *F24F 11/62* (2018.01);
(Continued)

(58) Field of Classification Search
CPC ..... F25B 49/02; F25B 2313/0315; F25B 2313/0253; F25B 2313/0233; F24F 11/30;
(Continued)

(56) References Cited

U.S. PATENT DOCUMENTS 5,247,806 A 9/1993 Ebisu et al.

FOREIGN PATENT DOCUMENTS

CN 102353121 A * 2/2012
CN 102353121 A 2/2012
(Continued)

OTHER PUBLICATIONS

Peimeng Huang, Control Method of Refrigerant Flow of Multi-connected unit, CN-102353121-A, European Patent Office, English Translation (Year: 2012).*
(Continued)

*Primary Examiner* — Frantz F Jules
*Assistant Examiner* — Steve S Tanenbaum
(74) *Attorney, Agent, or Firm* — Kilpatrick Townsend & Stockton; Charles Gray; Fei Shen

(57) ABSTRACT

Disclosed are a method and a device for controlling refrigerant in an air conditioning system. The method includes: S1: comparing a superheat degree of each outdoor unit with an average superheat degree; S2: if the superheat degree of a present outdoor unit is higher than the average superheat degree, and a first different between the superheat degree of the present outdoor unit and the average superheat degree is greater than a present value, increasing a refrigerant amount entered into the present outdoor unit; and S3: if the superheat
(Continued)

degree of the present outdoor unit is lower than the average superheat degree, and a second different between the average superheat degree and the superheat degree of the present outdoor unit is greater than the present value, decreasing the refrigerant amount entered into the present outdoor unit. Therefore, the refrigerant amount entered into each outdoor unit is adjusted from systemic overall perspective.

16 Claims, 2 Drawing Sheets

(51) Int. Cl.

| | |
|---|---|
| ***F24F 11/62*** | (2018.01) |
| ***F24F 11/00*** | (2018.01) |
| *F24F 110/12* | (2018.01) |
| *F24F 11/65* | (2018.01) |
| *F24F 110/10* | (2018.01) |

(52) U.S. Cl.
CPC ..... *F24F 11/65* (2018.01); *F24F 2110/10* (2018.01); *F24F 2110/12* (2018.01); *F25B 2313/0233* (2013.01); *F25B 2313/0253* (2013.01); *F25B 2313/0315* (2013.01)

(58) Field of Classification Search
CPC ..... F24F 11/62; F24F 11/00; F24F 2110/12; F24F 11/65; F24F 2110/10
USPC ..... 62/225
See application file for complete search history.

(56) References Cited

FOREIGN PATENT DOCUMENTS

| | | | | |
|---|---|---|---|---|
| CN | 103277876 | A | | 9/2013 |
| CN | 103375846 | A | * | 10/2013 |
| CN | 103375846 | A | | 10/2013 |
| CN | 103375871 | A | | 10/2013 |
| CN | 103851847 | A | | 6/2014 |
| CN | 104566823 | A | | 4/2015 |
| EP | 1657504 | A1 | | 5/2006 |
| JP | H085183 | A | | 1/1996 |
| JP | 2002-07-31 | A | | 7/2002 |
| JP | 2002195666 | A | | 7/2002 |

OTHER PUBLICATIONS

Hong Liang, Multi-to-one air conditioner control system, CN-103375846-A, European Patent Office, English Translation (Year: 2013).*
European Patent Application No. 15874888.9 extended Search and Opinion dated Jan. 5, 2018, 9 pages.
Chinese Patent Application No. CN201410849263.X First Office Action dated Nov. 2, 2016, with English translation, 13 pages.
Chinese Patent Application No. CN201410849263.X Second Office Action dated Jun. 8, 2017, with English translation, 13 pages.
PCT/CN2015/088396 English Translation of the International Search Report dated Dec. 16, 2015, 2 pages.

* cited by examiner

METHOD AND DEVICE FOR CONTROLLING REFRIGERATOR IN AIR CONDITIONING SYSTEM AND AIR CONDITIONING SYSTEM

CROSS-REFERENCE TO RELATED APPLICATION

This application is a U.S. national phase application based on International Application No. PCT/CN2015/088396, which claims priority to and benefits of Chinese Patent Application Serial No. 201410849263.X, filed with the State Intellectual Property Office of P. R. China on Dec. 29, 2014, the entire content of which is incorporated herein by reference.

FIELD

The present disclosure relates to refrigeration technology, and more particularly relates to a method and a device for controlling refrigerant in an air conditioning system, and an air conditioning system.

BACKGROUND

In an air conditioning system with multiple outdoor units connected in parallel, various differences, such as a size of a heat exchanger of each outdoor unit, an inspiratory capacity of a compressor of each outdoor unit, using environment and system loading changed over time, as well as installing standardized degree, may lead to an uneven distribution of refrigeration returned from an indoor unit(s) between the outdoor units when the outdoor units are operated in a heating mode. Less refrigeration distributed to some outdoor units may be evaporated easily in the heat exchangers of these outdoor units and overheat may be formed; more refrigeration distributed to some outdoor units cannot be evaporated completely because heat exchange capacities of the heat exchangers of these outdoor units are limited. As a result, the overheat degrees of some compressors are too high, while the overheat degrees of some compressors are too low. The too high overheat degree of the compressor may lead to a poor heat dissipation of a motor of the compressor, and too high temperature may also result in a metamorphism of refrigerant oil in the compressor easily so as to lead a poor lubrication, thereby influencing the lifetime of the compressor; on the other hand, the too low overheat degree of the compressor may indicate that the refrigeration at an admission port of the compressor may be in a liquid state, and compressibility of the redundant refrigeration which has not been evaporated completely may be poor, which may lead to an increase of current power of the compressor, and the refrigerant oil may be diluted at the same time because of the liquid refrigeration, which may lead to a decrease of the refrigerant oil entered into the compression chamber of the compressor, so as to aggravate abrasion of the compression chamber. According to adjusting methods in the related arts, a compressor of a single outdoor unit is generally treated as an object to adjust. However, the adjusting of each outdoor unit in the air conditioning system may influence each other, so that the air conditioning system may not acquire an overall control. Thus, the overheat degrees of compressors in the air conditioning system must be guaranteed in a proper range, and there should not be great differences between the overheat degrees of the outdoor units.

SUMMARY

A method for controlling refrigerant in an air conditioning system according to embodiments of the present disclosure includes:

S1: in a heating mode, comparing, by the processor, a overheat degree of each outdoor unit with an average overheat degree of a plurality of outdoor units;

S2: if the overheat degree of a present outdoor unit is higher than the average overheat degree, and a first difference between the overheat degree of the present outdoor unit and the average overheat degree is greater than a preset value, increasing, by the processor, a refrigerant amount entered into the present outdoor unit; and S3: if the overheat degree of the present outdoor unit is lower than the average overheat degree, and a second difference between the average overheat degree and the overheat degree of the present outdoor unit is greater than the preset value, decreasing, by the processor, the refrigerant amount entered into the present outdoor unit.

A device for controlling refrigerant in an air conditioning system according to embodiments of the present disclosure includes: temperature sensors set respectively in a plurality of outdoor units; a processor; and a memory, configured to store an instruction executable by the processor; in which the processor is configured to perform acts of:

acquiring temperature values from the temperature sensors;

calculating a overheat degree of each outdoor unit and an average overheat degree of the plurality of outdoor units according to the temperature values;

in a heating mode, comparing the overheat degree of each outdoor unit with the average overheat degree;

if the overheat degree of a present outdoor unit is higher than the average overheat degree, and a first difference between the overheat degree of the present outdoor unit and the average overheat degree is greater than a preset value, increasing a refrigerant amount entered into the present outdoor unit; and if the overheat degree of the present outdoor unit is lower than the average overheat degree, and a second difference between the average overheat degree and the overheat degree of the present outdoor unit is greater than the preset value, decreasing the refrigerant amount entered into the present outdoor unit.

An air conditioning system according to embodiments of the present disclosure includes the device for controlling refrigerant in an air conditioning system.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference to the drawings, in which.

DETAILED DESCRIPTION

Figure 1:
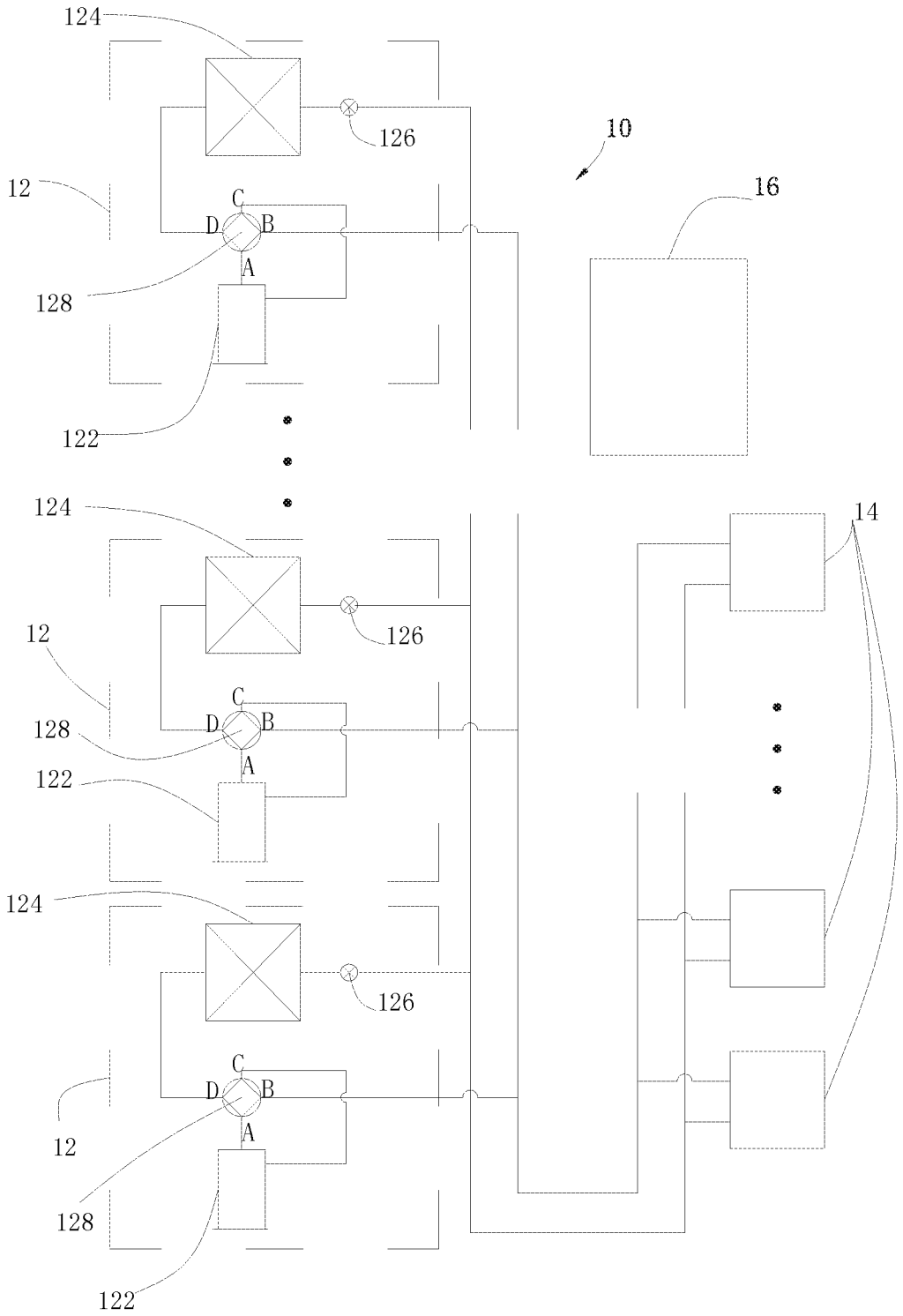
FIG. 1 is a schematic diagram of an air conditioning system applied with a system and a method for controlling refrigerant according to a preferable embodiment of the present disclosure.

Reference will be made in detail to embodiments of the present disclosure, where the same or similar elements and the elements having same or similar functions are denoted by like reference numerals throughout the descriptions. The embodiments described herein with reference to drawings are explanatory, and used to generally understand the present disclosure. The embodiments shall not be construed to limit the present disclosure.

The method for controlling refrigerant in an air conditioning system according to embodiments of the present disclosure will be further described with reference to drawings.

FIG. 1 depicts an air conditioning system 10 applied with a method for controlling refrigerant according to a preferable embodiment of the present disclosure. The air conditioning system 10 includes a plurality of outdoor units 12 connected in parallel and a plurality of indoor units 14 connected in parallel. The outdoor units 12 are connected with the indoor units 14, and the refrigerant (not depicted in the drawing, such as Freon) is cycled between the outdoor units 12 and the indoor units 14. When the air conditioning system 10 is heating, the refrigerant is compressed by a compressor 122 of the outdoor unit 12, and becomes gas with high temperature and high pressure and enters into a heat exchanger (which is a condenser now, not depicted in the drawing) of the indoor unit 14, and becomes liquid through condensation, liquidation and heat releasing. At the same time, the indoor air may be heated so as to increase the indoor temperature. The liquid may be decompressed through a throttling device, enter into a heat exchanger 124 (which is an evaporator now) of the outdoor unit 12, and becomes gas through evaporation, gasification and heat absorption. At the same time, heat of the outdoor gas may be absorbed (which means the outdoor gas may become colder). The gas refrigerant may enter into the compressor 122 again and start the next cycle.

Along with the trend of the refrigerant, each outdoor unit 12 also includes an electronic expansion valve 126 in front of the heat exchanger 124 and a four-way valve 128 in front of the compressor 122.

The electronic expansion valve 126 may adjust an open degree thereof according to a preset program or a control signal, so as to adjust a refrigerant amount entered into the heat exchanger 124. For example, the refrigerant amount entered into the outdoor unit 12 may be increased by turning up the open degree of the electronic expansion valve 126. On the contrary, the refrigerant amount entered into the outdoor unit 12 may be decreased by turning down the open degree of the electronic expansion valve 126. The electronic expansion valve 126 may be an electromagnetic expansion valve or a power-driven expansion valve. In this embodiment, the electronic expansion valve 126 is the electromagnetic expansion valve.

The four-way valve 128 has four hydraulic fluid ports A-D. In a heating mode, A connects to B, and C connects to D. The refrigerant may be compressed by the compressor 122 and become gap with high temperature and high pressure. The gap passes the port A of the four-way valve 128 and gets out through the port B, and then enters into the indoor heat exchanger (a condenser), and becomes liquid with medium temperature and high pressure after cold imbibition and heat releasing at the condenser, and becomes liquid with low temperature and low pressure through the electronic expansion valve 126, and becomes gas with low temperature and low pressure after heat imbibition and cold releasing at the outdoor heat exchanger 124 (an evaporator), and then passes the port D of the four-way valve 128 and back to the compressor 122 through the port C, and the cycle is continued thereafter.

The air conditioning system 10 of this embodiment also includes a system 16 for controlling refrigerant configured to control the refrigerant distribution between each outdoor unit 12. The system 16 may include a temperature sensor set in each outdoor unit 12 and a control system of the air conditioning system (not depicted in the drawing).

Figure 2:
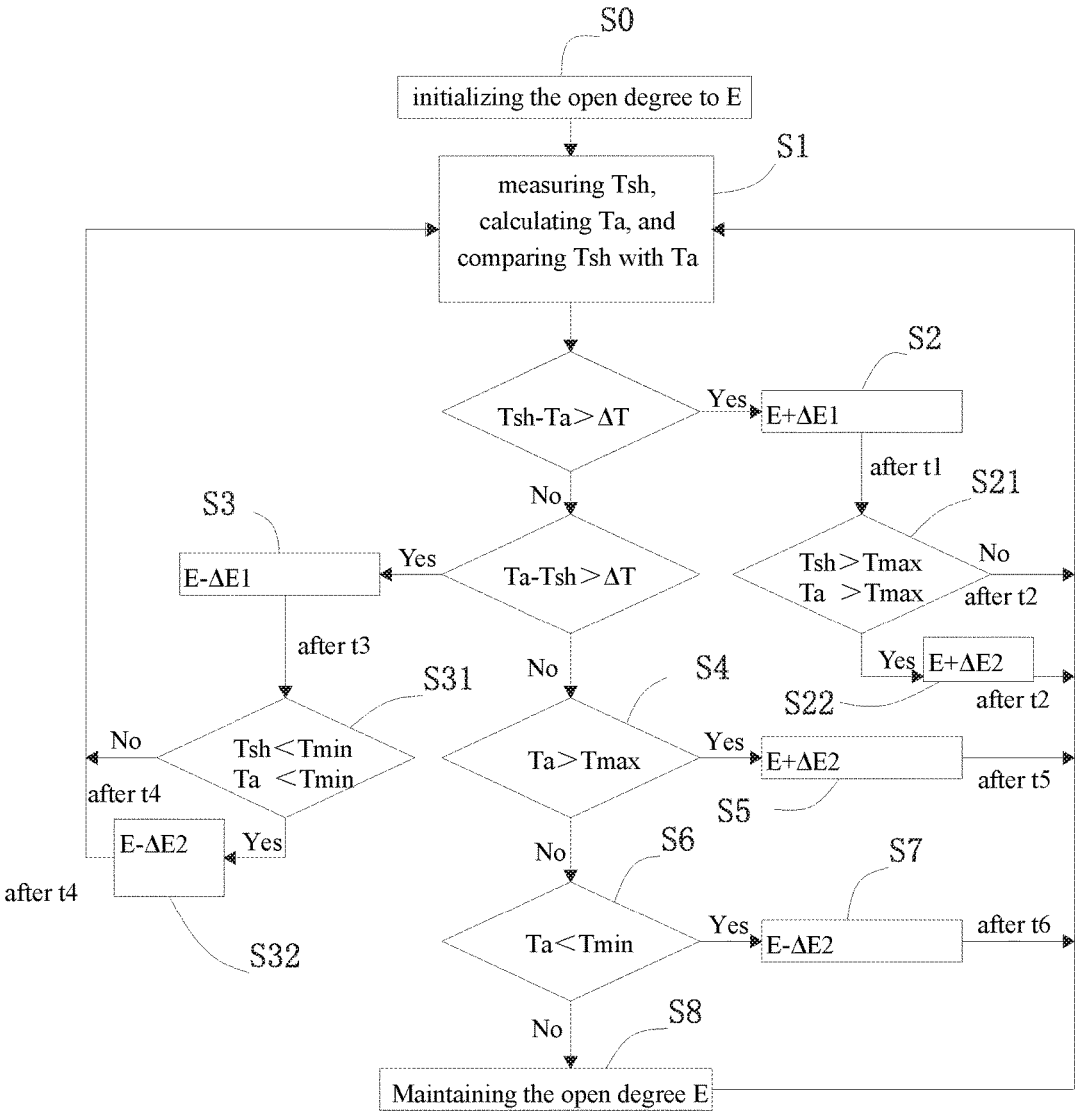
FIG. 2 is a flow chart of a method for controlling refrigerant according to a preferable embodiment of the present disclosure.

Referring to FIG. 2, the method for controlling refrigerant in a preferable embodiment of the present disclosure may be realized by the system 16, and includes the followings.

S1: in a heating mode, a overheat degree of each outdoor unit 12 is compared with an average overheat degree of the plurality of outdoor units 12;

S2: if the overheat degree Tsh of a present outdoor unit 12 is too high relative to the average overheat degree Ta, a refrigerant amount entered into the present outdoor unit 12 is increased; and S3: if the overheat degree Tsh of the present outdoor unit 12 is too low relative to the average overheat degree Ta, the refrigerant amount entered into the present outdoor unit 12 is decreased.

In the method and the system for controlling refrigerant in a preferable embodiment of the present disclosure, the refrigerant amount entered into each outdoor unit 12 is determined by comparing the overheat degree of the present outdoor unit 12 with the average overheat degree (system level). The refrigerant amount entered into each outdoor unit 12 is adjusted from a systemic overall perspective, so that the compressor 122 can work in a good operation range, avoiding problems resulting from too high or insufficient overheat degree of the compressor 122, and operation reliability of the air conditioning system 10 is increased.

In this embodiment, in the act S1, the overheat degree of the outdoor unit 12 is a overheat degree of the compressor 122 of the outdoor unit 12. In other embodiments, the overheat degree of the outdoor unit 12 may be a overheat degree at an outlet of a heat exchanger 124 of the outdoor unit 12.

The act S1 may be realized by the system 16. Specifically, the temperature sensors of the system 16 may measure various required temperature value (such as the temperature value of exhaust pipe of each compressor 122), and then the system 16 calculates the overheat degree Tsh of each outdoor unit 12 and the average overheat degree Ta according to the temperature values and conducts a comparing thereafter. In other words, in the act S1, temperature measuring and calculating the overheat degree Tsh of each outdoor unit 12 and the average overheat degree Ta are also included actually.

It should be noted firstly that, in this embodiment, in acts S2-S3, the present outdoor unit 12 refers to the outdoor unit 12 which is under the control currently. Actually, the system and the method for controlling refrigerant according to a preferable embodiment of the present disclosure may control each outdoor unit at the same time or in a certain order.

In this embodiment, in the act S2, the overheat degree Tsh of the present outdoor unit 12 is too high relative to the average overheat degree Ta, which indicates that $Tsh-Ta>\Delta T$. In the act S3, the overheat degree Tsh of the present outdoor unit 12 is too low relative to the average overheat degree Ta, which indicates that Ta−Tsh>ΔT. In the act S2, the refrigerant amount entered into the present outdoor unit 12 is increased by turning up the open degree of the electronic expansion valve 126 of the outdoor unit 12; in the act S3, the refrigerant amount entered into the present outdoor unit 12 is decreased by turning down the open degree of the electronic expansion valve 126 in front of the compressor 122 of the outdoor unit 12.

Certainly, in other embodiments, it is judged whether the overheat degree Tsh of the present outdoor unit 12 is too high or too low relative to the average overheat degree Ta in other ways and not be limited to this embodiment.

The acts S2-S3 may be realized by the system 16. Specifically, after comparing the overheat degree Tsh of the present outdoor unit 12 with the average overheat degree Ta, the system 16 may adjust the refrigerant amount into the present outdoor unit 12 by controlling the open degree of the electronic expansion valve 126 according to the comparing result. Thus, the open degree of the electronic expansion valve 126 is needed to be initialized at the time of initialization of the system and the method for controlling refrigerant.

Therefore, in this embodiment, the method for controlling refrigerant also includes followings.

S0: the open degree of the electronic expansion valve 126 is initialized to E.

In the act S2, a range of increasing the open degree E is ΔE1, i.e. E+ΔE1. In the act S3, a range of decreasing the open degree E is also ΔE1, i.e. E−ΔE1.

It may be understood that the specific values of E and ΔE1 depend on actual using environment and requirements.

In this embodiment, after the act S2, the method for controlling refrigerant also includes followings.

S21: it is judged whether both the overheat degree Tsh of the present outdoor unit 12 and the average overheat degree Ta are higher than a preset maximum overheat degree Tmax after a first preset time period t1; if they are, an act S22 is moved to, and if they are not, the act S1 is returned to after a second preset time period t2; and S22: the refrigerant amount entered into the present outdoor unit 12 is increased and the act S1 is returned to after the second preset time period t2.

It may be understood that, after adjusting in the act S2, and further after the first preset time period t1, if the overheat degree Tsh of the present outdoor unit 12 and the average overheat degree Ta are higher than the preset maximum overheat degree Tmax, it may be judged that the refrigerant amount of the present outdoor unit 12 is still insufficient. As a result, the overheat degree exceeds the preset maximum overheat degree Tmax and the average overheat degree Ta is pushed up correspondingly, so the refrigerant amount entered into the present outdoor unit 12 is needed to be increased in the act S22. In the act S22, a range of increasing the open degree E is ΔE2, i.e. E+ΔE2. After increasing the refrigerant amount entered into the present outdoor unit 12 in the act S22, the control may be conducted continuously when returning to the act S1 again after the second preset time period t2. Certainly, if it is not judged that the refrigerant amount of the present outdoor unit 12 is still insufficient, the control may be conducted continuously when returning to the act S1 again directly after the act S21.

The acts S21-S22 may be realized by the system 16. Specifically, the temperature sensors of the system 16 may measure various required temperature values (such as the temperature value of exhaust pipe of each compressor 122), and then the system calculates the overheat degree Tsh of each outdoor unit 12 and the average overheat degree Ta according to the temperature values and conducts a comparing with Tmax thereafter.

It may be understood that the specific values of ΔE2, the first preset time period t1 and the second preset time period t2 depend on actual using environment and requirements, and the values may be the same or may be different.

In this embodiment, after the act S3, the method for controlling refrigerant also includes followings.

S31: it is judged whether both the overheat degree Tsh of the present outdoor unit 12 and the average overheat degree Ta are lower than a preset minimum overheat degree Tmin after a third preset time period t3; if they are, the act S32 is moved to, and if they are not, the act S1 is returned after a fourth preset time period t4; and S32: the refrigerant amount entered into the present outdoor unit 12 is decreased and the act S1 is returned after the fourth preset time period t4.

It may be understood that, after adjusting in the act S3, and further after the third preset time period t3, if the overheat degree Tsh of the present outdoor unit 12 and the average overheat degree Ta are lower than the preset minimum overheat degree Tmin, it may be judged that the refrigerant amount of the present outdoor unit 12 is still overmuch. As a result, the overheat degree exceeds the preset minimum overheat degree Tmin and the average overheat degree Ta is pushed down correspondingly, so the refrigerant amount entered into the present outdoor unit 12 is needed to be decreased in the act S32. In the act S32, a range of decreasing the open degree E is ΔE2, i.e. E−ΔE2. After decreasing the refrigerant amount entered into the present outdoor unit 12 in act S32, the control may be conducted continuously when returning to the act S1 again after the fourth preset time period t4. Certainly, if it is not judged that the refrigerant amount of the present outdoor unit 12 is still insufficient, the control may be conducted continuously when returning to the act S1 again directly after the act S31.

The acts S31-S32 may be realized by the system 16. Specifically, the temperature sensors of the system 16 may measure various required temperature values (such as the temperature value of exhaust pipe of each compressor 122), and then the system calculates the overheat degree Tsh of each outdoor unit 12 and the average overheat degree Ta according to the temperature values and conducts a comparing with Tmin thereafter.

In this embodiment, if the overheat degree Tsh of the present outdoor unit 12 is not too high neither too low relative to the average overheat degree Ta, which means that Tsh−Ta>ΔT and Ta−Tsh>ΔT are both false, the method for controlling refrigerant also includes followings.

S4: if the overheat degree Tsh of the present outdoor unit is not too high or too low relative to the average overheat degree Ta, it is judged whether the average overheat degree Ta is greater than the preset maximum overheat degree Tmax;

S5: if the average overheat degree Ta is greater than the preset maximum overheat degree Tmax, the refrigerant amount entered into the present outdoor unit 12 is increased and the act S1 is returned to after a fifth preset time period t5;

S6: if the average overheat degree Ta is not greater than the preset maximum overheat degree Tmax, it is judged whether the average overheat degree Ta is smaller than the preset minimum overheat degree Tmin;

S7: if the average overheat degree Ta is smaller than the preset minimum overheat degree Tmin, the refrigerant amount entered into the present outdoor unit 12 is decreased, and the act S1 is returned to after a sixth preset time period;

S8: if the average overheat degree Ta is not smaller than the preset minimum overheat degree Tmin, the refrigerant amount entered into the present outdoor unit 12 is maintained.

It may be understood that, adding the acts S4-S8 is to avoid that it is not the too high or too low overheat degree of the whole system. Under this circumstance, although the overheat degree of a single outdoor unit 12 is unable to compare with that of the system so as to judge whether the overheat degree is too high or too low, the refrigerant amount of the present outdoor unit 12 is needed to be controlled according to the overheat degree of the system. In other words, if it is judged that the overheat degree of the system is too high in the act S4 and is greater than the maximum overheat degree Tmax, the refrigerant amount of the present outdoor unit 12 may be increased in the act S5 and the control may be conducted continuously when returning to the act S1 after the fifth preset time period t5, otherwise, it is judged that the overheat degree of the system is too low in the act S5 after the act S4 and is smaller than the minimum overheat degree Tmin, the refrigerant amount of the present outdoor unit 12 may be decreased in the act S7 and the control may be conducted continuously when returning to the act S1 after the sixth preset time period t6, otherwise, the overheat degree of the system is proved as normal and the open degree E is maintained.

In the act S5, the range of increasing the open degree E is ΔE2, i.e. E+ΔE2. In the act S8, the range of decreasing the open degree E is also ΔE2, i.e. E−ΔE2.

The acts S4-S8 may be realized by the system 16. Specifically, the temperature sensors of the system 16 may measure various required temperature values (such as the temperature value of exhaust pipe of each compressor 122), and then the system 16 calculates the average overheat degree Ta according to the temperature values and conducts a comparing with the maximum overheat degree Tmax and the minimum overheat degree Tmin thereafter.

It may be understood that the first preset time period t1, the second preset time period t2, the third preset time period t3, the fourth preset time period t4, the fifth preset time period t5 and the sixth preset time period t6 may be the same or may be different. ΔE1 and ΔE2 may also be the same or may be different.

In the description of embodiments of the present disclosure, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," "counterclockwise" etc. should be construed to refer to the orientation or position relations as then described or as shown in the drawings under discussion, but do not alone indicate or imply that the device or element referred to must have a particular orientation, and it is not required that the present disclosure is constructed or operated in a particular orientation. Thus, it should not be understood as a limitation of the present disclosure. In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present invention, "a plurality of" means two or more than two, unless specified otherwise.

In the description of embodiments of the present disclosure, it is to be understood that, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the embodiments of the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Various embodiments and examples are provided in the following description to implement different structures of the present disclosure. In order to simplify the present disclosure, certain elements and settings will be described. However, these elements and settings are only by way of example and are not intended to limit the present disclosure. In addition, reference numerals may be repeated in different examples in the present disclosure. This repeating is for the purpose of simplification and clarity and does not refer to relations between different embodiments and/or settings. Furthermore, examples of different processes and materials are provided in the present disclosure. However, it would be appreciated by those skilled in the art that other processes and/or materials may be also applied.

In the description of embodiments of the present disclosure, reference throughout this specification to "one embodiment", "some embodiments," "an embodiment", "a specific example," or "some examples," means that a particular feature, structure, material, or characteristic described in connection with the embodiment or example is included in at least one embodiment or example of the present disclosure. In this specification, the appearances of the phrases in various places throughout this specification are not necessarily referring to the same embodiment or example of the present disclosure. Furthermore, the particular features, structures, materials, or characteristics may be combined in any suitable manner in one or more embodiments or examples.

Any process or method described in a flow chart or described herein in other ways may be understood to include one or more modules, segments or portions of codes of executable instructions for achieving specific logical functions or steps in the process, and the scope of a preferred embodiment of the present disclosure includes other embodiments, which may not follow a shown or discussed order according to the related functions in a substantially simultaneous manner or in a reverse order, to perform the function, which should be understood by those skilled in the art.

The logic and/or step described in other manners herein or shown in the flow chart, for example, a particular sequence table of executable instructions for realizing the logical function, may be specifically achieved in any computer readable medium to be used by the instruction execution system, device or equipment (such as the system based on computers, the system comprising processors or other systems capable of obtaining the instruction from the instruction execution system, device and equipment and executing the instruction), or to be used in combination with the instruction execution system, device and equipment. As to the specification, "the computer readable medium" may be any device adaptive for including, storing, communicating, propagating or transferring programs to be used by or in combination with the instruction execution system, device or equipment. More specific examples of the computer readable medium comprise but are not limited to: an electronic connection (an electronic device) with one or more wires, a portable computer enclosure (a magnetic device), a random access memory (RAM), a read only memory (ROM), an erasable programmable read-only memory (EPROM or a flash memory), an optical fiber device and a portable compact disk read-only memory (CDROM). In addition, the computer readable medium may even be a paper or other appropriate medium capable of printing programs thereon, this is because, for example, the paper or other appropriate medium may be optically scanned and then edited, decrypted or processed with other appropriate methods when necessary to obtain the programs in an electric manner, and then the programs may be stored in the computer memories.

It should be understood that each part of the present disclosure may be realized by the hardware, software, firmware or their combination. In the above embodiments, a plurality of steps or methods may be realized by the software or firmware stored in the memory and executed by the appropriate instruction execution system. For example, if it is realized by the hardware, likewise in another embodiment, the steps or methods may be realized by one or a combination of the following techniques known in the art: a discrete logic circuit having a logic gate circuit for realizing a logic function of a data signal, an application-specific integrated circuit having an appropriate combination logic gate circuit, a programmable gate array (PGA), a field programmable gate array (FPGA), etc.

Those skilled in the art shall understand that all or parts of the steps in the above exemplifying method of the present disclosure may be achieved by commanding the related hardware with programs. The programs may be stored in a computer readable storage medium, and the programs comprise one or a combination of the steps in the method embodiments of the present disclosure when run on a computer.

In addition, each function cell of the embodiments of the present disclosure may be integrated in a processing module, or these cells may be separate physical existence, or two or more cells are integrated in a processing module. The integrated module may be realized in a form of hardware or in a form of software function modules. When the integrated module is realized in a form of software function module and is sold or used as a standalone product, the integrated module may be stored in a computer readable storage medium.

The storage medium mentioned above may be read-only memories, magnetic disks, CD, etc.

Although embodiments have been shown and described, it would be appreciated that the above embodiments are explanatory and cannot be construed to limit the present disclosure, and changes, alternatives, and modifications can be made in the embodiments without departing from scope of the present disclosure by those skilled in the art.

What is claimed is:

1. A method for controlling refrigerant in an air conditioning system with a plurality of outdoor units, comprising: comparing, in a heating mode, a superheat degree of one of the plurality of outdoor units with an average superheat degree of the plurality of outdoor units; in response to determining that the superheat degree of the one of the plurality of outdoor units is higher than the average superheat degree, and a first difference between the superheat degree of the one of the plurality of outdoor units and the average superheat degree is greater than a preset value, increasing a refrigerant amount entered into the one of the plurality of outdoor units; in response to determining that both the superheat degree of the one of the plurality of outdoor units and the average superheat degree are higher than a first preset superheat degree after a first preset time period, increasing the refrigerant amount entered into the one of the plurality of outdoor units, and comparing, in the heating mode, the superheat degree of the one of the plurality of outdoor units with the average superheat degree of the plurality of outdoor units again after a second preset time period; in response to determining that either the superheat degree of the one of the plurality of outdoor units or the average superheat degree is higher than the first preset superheat degree after the first preset time period, comparing, in the heating mode, the superheat degree of the one of the plurality of outdoor units with the average superheat degree of the plurality of outdoor units again after the second preset time period; and in response to determining that the superheat degree of the one of the plurality of outdoor units is lower than the average superheat degree, and a second difference between the average superheat degree and the superheat degree of the one of the plurality of outdoor units is greater than the preset value, decreasing the refrigerant amount entered into the one of the plurality of outdoor units.

2. The method according to claim 1, wherein the superheat degree of the outdoor unit is a superheat degree of a compressor of the outdoor unit or a superheat degree at an outlet of a heat exchanger of the outdoor unit.

3. The method according to claim 1, wherein increasing the refrigerant amount entered into the one of the plurality of outdoor units comprises: sending an increasing signal to an electronic expansion valve in front of a compressor of the one of the plurality of outdoor units, so that the electronic expansion valve turns up an open degree of the electronic expansion valve based on the increasing signal; and decreasing the refrigerant amount entered into the one of the plurality of outdoor units comprises: sending a decreasing signal to the electronic expansion valve in front of the compressor of the one of the plurality of outdoor units, so that the electronic expansion valve turns down the open degree of the electronic expansion valve based on the decreasing signal.

4. The method according to claim 1, further comprising: acquiring temperature values from the plurality of outdoor units; and calculating the superheat degree of the one of the plurality of outdoor units and the average superheat degree according to the temperature values.

5. The method according to claim 1, after decreasing the refrigerant amount entered into the one of the plurality of outdoor units and sending the decreasing signal to the electronic expansion valve to decrease the open degree of the electronic expansion valve, the method further comprising: in response to determining that both the superheat degree of the one of the plurality of outdoor units and the average superheat degree are lower than a second preset superheat degree after a third preset time period, decreasing the refrigerant amount entered into the one of the plurality of outdoor units, and comparing, in the heating mode, the superheat degree of the one of the plurality of outdoor units with the average superheat degree of the plurality of outdoor units again after a fourth preset time period, wherein the second preset superheat degree is smaller than the first preset superheat degree; and in response to determining that either the superheat degree of the one of the plurality of outdoor units or the average superheat degree is lower than the second preset superheat degree after the third preset time period, comparing, in the heating mode, the superheat degree of the one of the plurality of outdoor units with the average superheat degree of the plurality of outdoor units again after the fourth preset time period.

6. The method according to claim 5, further comprising: in response to determining that the first difference or the second difference is less than or equal to the preset value, and the average superheat degree is greater than the first preset superheat degree, increasing the refrigerant amount entered into the one of the plurality of outdoor units, and comparing, in the heating mode, the superheat degree of the one of the plurality of outdoor units with the average superheat degree of the plurality of outdoor units again after a fifth preset time period; in response to determining that the first difference or the second difference is less than or equal to the preset value, the average superheat degree is not greater than the first preset superheat degree, and the average superheat degree is smaller than the second preset superheat degree, decreasing the refrigerant amount entered into the one of the plurality of outdoor units, and comparing, in the heating mode, the superheat degree of the one of the plurality of outdoor units with the average superheat degree of the plurality of outdoor units again after a sixth preset time period, wherein the second preset superheat degree is smaller than the first preset superheat degree; and in response to determining that the first difference or the second difference is less than or equal to the preset value, the average superheat degree is not greater than the first preset superheat degree, and the average superheat degree is not smaller than the second preset superheat degree, maintaining the refrigerant amount entered into the one of the plurality of outdoor units.

7. A device for controlling refrigerant in an air conditioning system with a plurality of outdoor units, comprising: temperature sensors set respectively in the plurality of outdoor units; and a control system of the air conditioning system; wherein the control system is configured to perform acts of: acquiring temperature values from the temperature sensors; calculating a superheat degree of one of the plurality of outdoor units and an average superheat degree of the plurality of outdoor units according to the temperature values; comparing, in a heating mode, the superheat degree of the one of the plurality of outdoor units with the average superheat degree; in response to determining that the superheat degree of the one of the plurality of outdoor units is higher than the average superheat degree, and a first difference between the superheat degree of the one of the plurality of outdoor units and the average superheat degree is greater than a preset value, increasing a refrigerant amount entered into the one of the plurality of outdoor units; in response to determining that both the superheat degree of the one of the plurality of outdoor units and the average superheat degree are higher than a first preset superheat degree after a first preset time period, increasing the refrigerant amount entered into the one of the plurality of outdoor units, and comparing, in the heating mode, the superheat degree of the one of the plurality of outdoor units with the average superheat degree of the plurality of outdoor units again after a second preset time period; in response to determining that either the superheat degree of the one of the plurality of outdoor units or the average superheat degree is higher than the first preset superheat degree after the first preset time period, comparing, in the heating mode, the superheat degree of the one of the plurality of outdoor units with the average superheat degree of the plurality of outdoor units again after the second preset time period; and in response to determining that the superheat degree of the one of the plurality of outdoor units is lower than the average superheat degree, and a second difference between the average superheat degree and the superheat degree of the one of the plurality of outdoor units is greater than the preset value, decreasing the refrigerant amount entered into the one of the plurality of outdoor units.

8. The device according to claim 7, wherein each one of the temperature sensors is set at a compressor of the outdoor unit or at an outlet of a heat exchanger of the outdoor unit.

9. The device according to claim 7, wherein the control system is configured to increase the refrigerant amount entered into the one of the plurality of outdoor units by an act of sending an increasing signal to an electronic expansion valve in front of a compressor of the one of the plurality of outdoor units, so that the electronic expansion valve turns up an open degree of the electronic expansion valve based on the increasing signal; and the control system is configured to decrease the refrigerant amount entered into the one of the plurality of outdoor units by an act of sending a decreasing signal to the electronic expansion valve in front of the compressor of the one of the plurality of outdoor units, so that the electronic expansion valve turns down the open degree of the electronic expansion valve based on the decreasing signal.

10. The device according to claim 7, wherein the control system is further configured to perform acts of: in response to determining that both the superheat degree of the one of the plurality of outdoor units and the average superheat degree are lower than a second preset superheat degree after a third preset time period, decreasing the refrigerant amount entered into the one of the plurality of outdoor units, and comparing, in the heating mode, the superheat degree of the one of the plurality of outdoor units with the average superheat degree of the plurality of outdoor units again after a fourth preset time period, wherein the second preset superheat degree is smaller than the first preset superheat degree; and in response to determining that either the superheat degree of the one of the plurality of outdoor units or the average superheat degree is lower than the second preset superheat degree after the third preset time period, comparing, in the heating mode, the superheat degree of the one of the plurality of outdoor units with the average superheat degree of the plurality of outdoor units again after the fourth preset time period.

11. The device according to claim 10, wherein the control system is further configured to perform acts of: in response to determining that the first difference or the second difference is less than or equal to the preset value, and the average superheat degree is greater than the first preset superheat degree, increasing the refrigerant amount entered into the one of the plurality of outdoor units, and comparing, in the heating mode, the superheat degree of the one of the plurality of outdoor units with the average superheat degree of the plurality of outdoor units again after a fifth preset time period; in response to determining that the first difference or the second difference is less than or equal to the preset value, the average superheat degree is not greater than the first preset superheat degree, and the average superheat degree is smaller than the second preset superheat degree, decreasing the refrigerant amount entered into the one of the plurality of outdoor units, and comparing, in the heating mode, the superheat degree of the one of the plurality of outdoor units with the average superheat degree of the plurality of outdoor units again after a sixth preset time period, wherein the second preset superheat degree is smaller than the first preset superheat degree; and in response to determining that the first difference or the second difference is less than or equal to the preset value, the average superheat degree is not greater than the first preset superheat degree, and the average superheat degree is not smaller than the second preset superheat degree, maintaining the refrigerant amount entered into the one of the plurality of outdoor units.

12. An air conditioning system comprising a device for controlling refrigerant in an air conditioning system with a plurality of outdoor units comprising: temperature sensors set respectively in the plurality of outdoor units; and a control system of the air conditioning system; wherein the control system is configured to perform acts of: acquiring temperature values from the temperature sensors; calculating a superheat degree of one of the plurality of outdoor units and an average superheat degree of the plurality of outdoor units according to the temperature values; comparing, in a heating mode, the superheat degree of the one of the plurality of outdoor units with the average superheat degree; in response to determining that the superheat degree of the one of the plurality of outdoor units is higher than the average superheat degree, and a first difference between the superheat degree of the one of the plurality of outdoor units and the average superheat degree is greater than a preset value, increasing a refrigerant amount entered into the one of the plurality of outdoor units; in response to determining that both the superheat degree of the one of the plurality of outdoor units and the average superheat degree are higher than a first preset superheat degree after a first preset time period, increasing the refrigerant amount entered into the one of the plurality of outdoor units, and comparing, in the heating mode, the superheat degree of the one of the plurality of outdoor units with the average superheat degree of the plurality of outdoor units again after a second preset time period; in response to determining that either the superheat degree of the one of the plurality of outdoor units or the average superheat degree is higher than the first preset superheat degree after the first preset time period, comparing, in the heating mode, the superheat degree of the one of the plurality of outdoor units with the average superheat degree of the plurality of outdoor units again after the second preset time period; and in response to determining that the superheat degree of the one of the plurality of outdoor units is lower than the average superheat degree, and a second difference between the average superheat degree and the superheat degree of the one of the plurality of outdoor units is greater than the preset value, decreasing the refrigerant amount entered into the one of the plurality of outdoor units.

13. The air conditioning system according to claim 12, wherein each one of the temperature sensors is set at a compressor of the outdoor unit or at an outlet of a heat exchanger of the outdoor unit.

14. The air conditioning system according to claim 12, wherein the control system is configured to increase the refrigerant amount entered into the one of the plurality outdoor units by an act of sending an increasing signal to an electronic expansion valve in front of a compressor of the one of the plurality outdoor units, so that the electronic expansion valve turns up an open degree of the electronic expansion valve based on the increasing signal; and the control system is configured to decrease the refrigerant amount entered into the one of the plurality outdoor units by an act of sending a decreasing signal to the electronic expansion valve in front of the compressor of the one of the plurality outdoor units, so that the electronic expansion valve turns down the open degree of the electronic expansion valve based on the decreasing signal.

15. The air conditioning system according to claim 12, the control system is further configured to perform acts of: in response to determining that both the superheat degree of the one of the plurality of outdoor units and the average superheat degree are lower than a second preset superheat degree after a third preset time period, decreasing the refrigerant amount entered into the one of the plurality of outdoor units, and comparing, in the heating mode, the superheat degree of the one of the plurality of outdoor units with the average superheat degree of the plurality of outdoor units again after a fourth preset time period, wherein the second preset superheat degree is smaller than the first preset superheat degree; and in response to determining that either the superheat degree of the one of the plurality of outdoor units or the average superheat degree is lower than the second preset superheat degree after the third preset time period, comparing, in the heating mode, the superheat degree of the one of the plurality of outdoor units with the average superheat degree of the plurality of outdoor units again after the fourth preset time period.

16. The air conditioning system according to claim 15, the processor is further configured to perform acts of: in response to determining that the first difference or the second difference is less than or equal to the preset value, and the average superheat degree is greater than the first preset superheat degree, increasing the refrigerant amount entered into the one of the plurality of outdoor units, and comparing, in the heating mode, the superheat degree of the one of the plurality of outdoor units with the average superheat degree of the plurality of outdoor units again after a fifth preset time period; in response to determining that the first difference or the second difference is less than or equal to the preset value, the average superheat degree is not greater than the first preset superheat degree, and the average superheat degree is smaller than the second preset superheat degree, decreasing the refrigerant amount entered into the one of the plurality of outdoor units, and comparing, in the heating mode, the superheat degree of the one of the plurality of outdoor units with the average superheat degree of the plurality of outdoor units again after a sixth preset time period, wherein the second preset superheat degree is smaller than the first preset superheat degree; and in response to determining that the first difference or the second difference is less than or equal to the preset value, the average superheat degree is not greater than the first preset superheat degree, and the average superheat degree is not smaller than the second preset superheat degree, maintaining the refrigerant amount entered into the one of the plurality of outdoor units.

* * * * *